US009133737B2

(12) United States Patent
Breuer et al.

(10) Patent No.: US 9,133,737 B2
(45) Date of Patent: Sep. 15, 2015

(54) MECHANICALLY CONTROLLABLE VALVE DRIVE AND MECHANICALLY CONTROLLABLE VALVE DRIVE ARRANGEMENT

(75) Inventors: Michael Breuer, Simmerath (DE); Karsten Grimm, Aachen (DE)

(73) Assignee: KOLBENSCHMIDT PIERBURG INNOVATIONS GMBH, Neckarsulm (DE)

( * ) Notice: Subject to any disclaimer, the term of this patent is extended or adjusted under 35 U.S.C. 154(b) by 128 days.

(21) Appl. No.: 14/006,322

(22) PCT Filed: Jan. 24, 2012

(86) PCT No.: PCT/EP2012/051020
§ 371 (c)(1), (2), (4) Date: Sep. 20, 2013

(87) PCT Pub. No.: WO2012/126648
PCT Pub. Date: Sep. 27, 2012

(65) Prior Publication Data

US 2014/0000538 A1 Jan. 2, 2014

(30) Foreign Application Priority Data

Mar. 22, 2011 (DE) ..... 10 2011 014 744

(51) Int. Cl.
*F01L 1/34* (2006.01)
*F01L 13/00* (2006.01)

(52) U.S. Cl.
CPC ..... *F01L 13/0026* (2013.01); *F01L 13/0015* (2013.01)

(58) Field of Classification Search
CPC ... F01L 1/34403; F01L 1/185; F01L 13/0063; F01L 13/0021; F01L 2013/0068; F01L 2013/0073
USPC ..... 123/90.16
See application file for complete search history.

(56) References Cited

U.S. PATENT DOCUMENTS

| | | | |
|---|---|---|---|
| 5,373,818 | A | 12/1994 | Unger |
| 6,016,779 | A | 1/2000 | Nemoto et al. |
| 6,085,707 | A | 7/2000 | Nemoto et al. |
| 6,138,620 | A | 10/2000 | Nemoto et al. |
| 2004/0069083 | A1 | 4/2004 | Zaers et al. |
| 2004/0147356 | A1 | 7/2004 | Baxter, Jr. et al. |

(Continued)

FOREIGN PATENT DOCUMENTS

| | | | |
|---|---|---|---|
| DE | 698 12 839 | T2 | 11/2003 |
| DE | 10 2004 003 324 | A1 | 8/2004 |

(Continued)

*Primary Examiner* — Thomas Denion
*Assistant Examiner* — Daniel Bernstein
(74) *Attorney, Agent, or Firm* — Norman B. Thot

(57) ABSTRACT

A mechanically controllable valve drive includes a gas exchange valve on which a transmission arrangement acts via a working contour. The transmission arrangement comprises a first wheel element comprising a toothing which is connected to a camshaft, and a second wheel element comprising a toothing which acts on the gas exchange valve. The transmission arrangement is mounted to move in a cylinder head via a bearing, and is operatively connected to the camshaft and to a valve stroke adjusting device comprising an adjusting shaft. The first and second wheel elements are each mounted to rotate on the adjusting shaft and to be in a geared connection with each another via their respective toothing so that a rotation of the adjusting shaft effects a phase shift between the first and second wheel elements and so that a rotary fixing generates an oscillating movement of the first and second wheel elements.

20 Claims, 4 Drawing Sheets

(56) References Cited

U.S. PATENT DOCUMENTS

| | | | | |
|---|---|---|---|---|
| 2005/0154522 | A1 | 7/2005 | Fuwa et al. | |
| 2006/0000433 | A1 | 1/2006 | Suzuki et al. | |
| 2007/0137614 | A1* | 6/2007 | Tsuzuki | 123/321 |
| 2007/0163525 | A1* | 7/2007 | Fuwa et al. | 123/90.16 |
| 2008/0087241 | A1 | 4/2008 | Taye et al. | |
| 2011/0107989 | A1 | 5/2011 | Ohsawa | |

FOREIGN PATENT DOCUMENTS

| | | | |
|---|---|---|---|
| DE | 102 35 677 | B4 | 3/2005 |
| DE | 10 2006 035391 | A | 6/2007 |
| DE | 10 2009 007 454 | A1 | 8/2010 |
| EP | 0 638 706 | A1 | 2/1995 |
| EP | 0 826 866 | A2 | 3/1998 |
| EP | 0 913 557 | A2 | 5/1999 |
| EP | 1 760 278 | A2 | 3/2007 |
| EP | 2 322 771 | A1 | 5/2011 |
| JP | 2007-127189 | A | 5/2007 |
| JP | 2008-101609 | A | 5/2008 |
| JP | 2009-62895 | A | 3/2009 |
| JP | 2010-48097 | A | 3/2010 |
| KR | 1019990037498 | A | 5/1999 |

* cited by examiner

MECHANICALLY CONTROLLABLE VALVE DRIVE AND MECHANICALLY CONTROLLABLE VALVE DRIVE ARRANGEMENT

CROSS REFERENCE TO PRIOR APPLICATIONS

This application is a U.S. National Phase application under 35 U.S.C. §371 of International Application No. PCT/EP2012/051020, filed on Jan. 24, 2012 and which claims benefit to German Patent Application No. 10 2011 014 744.6, filed on Mar. 22, 2011. The International Application was published in German on Sep. 27, 2012 as WO 2012/126648 A1 under PCT Article 21(2).

FIELD

The present invention relates to a mechanically controllable valve drive having a gas exchange valve on which a transmission arrangement acts directly or indirectly by means of a working contour, wherein the transmission arrangement is mounted in a movable manner in the cylinder head by bearing means, and wherein the transmission arrangement is operatively connected to a valve stroke adjusting device and to a camshaft, wherein the valve stroke adjusting device has a rotatable adjusting shaft such that different maximum strokes can be set. The present invention further relates to a mechanically controllable valve drive arrangement having a plurality of serially arranged gas exchange valves assigned to a plurality of cylinders.

BACKGROUND

Such a valve drive and such a valve drive arrangement are described, for example, in EP 638 706 A1, where, for control or feedback control of the valve stroke, an eccentric shaft is provided which is rotatably supported in the cylinder head and which acts on the transmission arrangement to the effect that valve strokes between zero and maximum can be set in a simple manner. The combustion process can thereby be adequately adapted to the respective operating state of the internal combustion engine. DE 10 2004 003 324 A1 describes providing a valve drive arrangement with adjusting members which can be adjusted independently from each other in order to bring individual cylinders to a standstill for specific operational states. EP 1 760 278 A2 describes a valve drive comprising an eccentric member with various curve shapes, particularly for partial stroke and full stroke. A zero stroke is made possible in this drive by the adjustment member.

These known valve drives/valve drive arrangements have the disadvantage, however, that an adjustment of the valve is performed via a translatory and rotary movement of an intermediate lever of the transmission arrangement. There must consequently also be provided a very complicated guidance of the intermediate lever, which dictates narrow tolerances in manufacture and assembly. The resulting overall construction of the transmission arrangement will thereby be expensive and be controllable only with difficulty.

SUMMARY

An aspect of the present invention is to provide a valve drive and/or a valve drive arrangement which avoid the above outlined disadvantages.

In an embodiment, the present invention provides a mechanically controllable valve drive which includes a gas exchange valve on which a transmission arrangement is configured to directly or indirectly act via a working contour. The transmission arrangement comprises a first wheel element comprising a toothing which is operatively connected to a camshaft, and a second wheel element comprising a toothing which is configured to act directly or indirectly on the gas exchange valve. The transmission arrangement is mounted so as to be movable in a cylinder head via a bearing, and to be operatively connected to a camshaft and to a valve stroke adjusting device comprising an adjusting shaft which is configurable to be rotatable and to set different maximum strokes. The first wheel element and the second wheel element are each mounted on the adjusting shaft so as to rotate and to be in a geared connection with each another via their respective toothing so that a rotation of the adjusting shaft effects a phase shift between the first wheel element and the second wheel element, and so that a rotary fixing generates an oscillating movement of the first wheel element and the second wheel element.

BRIEF DESCRIPTION OF THE DRAWINGS

The present invention is described in greater detail below on the basis of embodiments and of the drawings in which.

DETAILED DESCRIPTION

Figure 1:
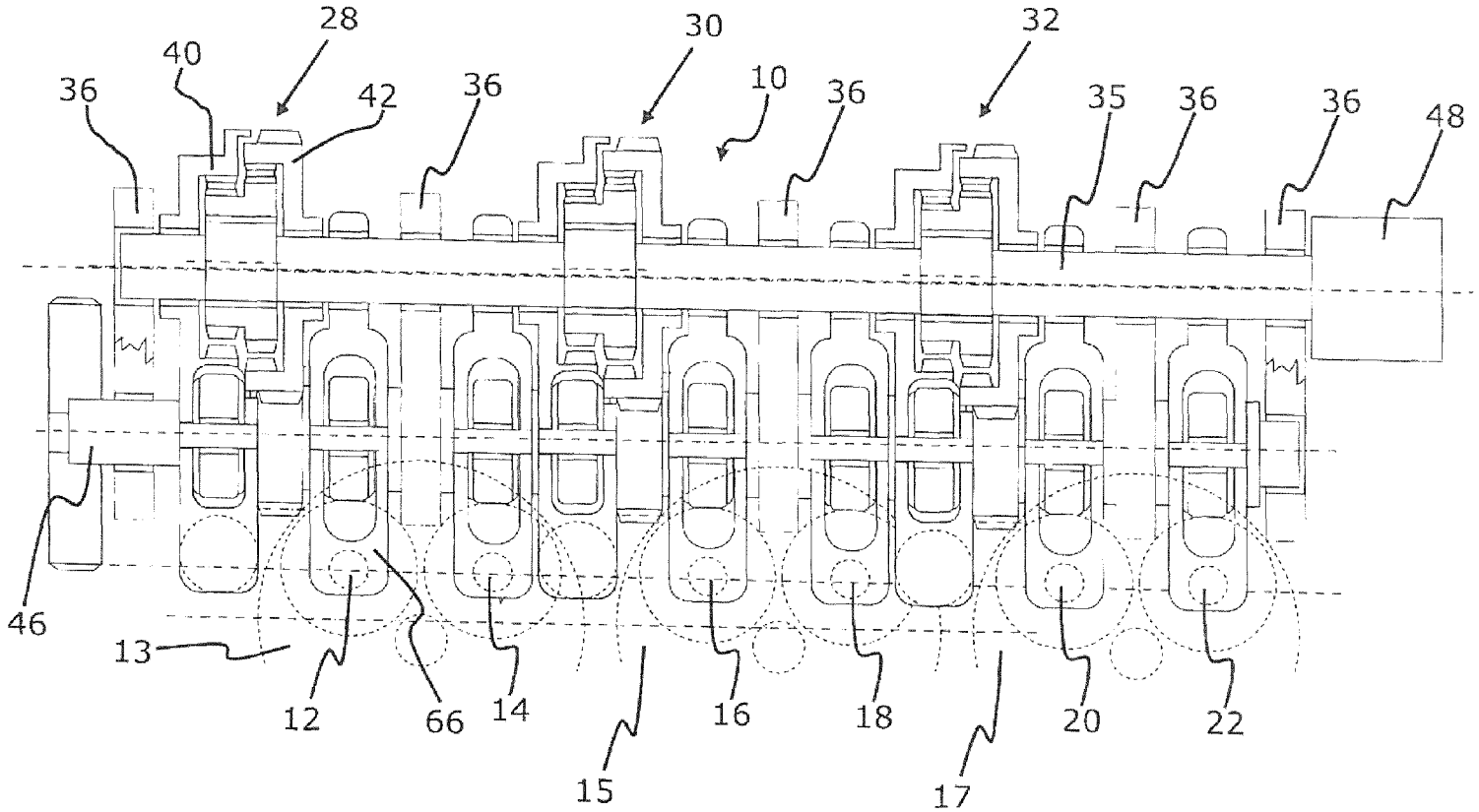
FIG. 1 shows a cross-sectional view of a valve drive arrangement according to the present invention.

The transmission arrangement has a first and a second wheel element, wherein the first wheel element is operatively connected to the camshaft and the second wheel element acts directly or indirectly on the gas exchange valve, wherein the two wheel elements are rotatably mounted on the adjusting shaft and have a toothing so that the first and the second wheel element are in a geared connection with one another such that a rotation of the adjusting shaft effects a phase shift between the first and the second wheel element and such that rotary fixing is effective to generate an oscillating movement of the first and second wheel elements. In this manner, a mechanical valve drive is created which is designed to merely require a rotational movement in order to effect a valve stroke displacement. This also allows for a substantially simpler support of the transmission arrangement so that wear developments can be substantially minimized.

In an embodiment of the present invention, the first wheel element is biased relative to the camshaft by a spring element.

It is thereby possible to drive the adjustment shaft in both directions. Play in the toothing can further be compensated for.

In an embodiment of the present invention, the first and the second wheel element can, for example, be formed as mutually confronting crown gears and that the gear connection can be realized via at least one planetary gear, each planetary gear being supported on an axis connected to the adjusting shaft for common rotation therewith. This embodiment is a planetary gear transmission formed as a planetary gear transmission.

In an embodiment of the present invention, the first and the second wheel element can, for example, be formed as internal gears, wherein the first wheel element has a different inner diameter with a different number of teeth than the second wheel element, and the adjustment shaft comprises an eccentric having a first and a second spur gear rotatably supported thereon which are coupled to each other in a torsionally rigid manner and are in engagement with the first and respectively the second wheel element, thus forming the gear connection. By means of such an embodiment, it is possible in a simple manner, in case of a design with a small difference of teeth between the first and the second wheel element, to achieve a high gear reduction of the adjustment shaft relative to the phase shift between the first and the second wheel element. This high internal gear reduction has the benefit that, on the one hand, only small actuator forces will be required for driving the adjustment shaft, and, on the other hand, the maximum valve strokes of the gas exchange valves can be set with very high precision. It is advantageous in this regard under the aspect of assembly and production technology if the first and the second spur gears are formed as one part. A mechanically controllable valve drive having a particularly compact design is created in that the second wheel element is rotatably supported on the peripheral surface of the first wheel element.

It is advantageous if the first wheel element comprises a contact roll for the camshaft so that, under the action of the continuously rotating camshaft, the first wheel element is caused to rotate in an oscillating manner about the axis of the adjustment shaft. The second wheel element can be advantageously designed in such a manner that it comprises the working contour.

In an embodiment of the present invention, the second wheel element can, for example, be in a geared connection with a deflecting member comprising said working contour, said deflecting member being rotatably and concentrically supported on the camshaft. It is advantageous under the aspect of assembly and production technology in this regard if a drag lever is rotatably supported on the adjusting shaft. This makes it possible to realize a transmission arrangement and drag lever unit which can be examined in advance and be easily mounted.

The above mentioned aspect is further achieved by a mechanically controllable valve drive arrangement wherein each cylinder has assigned thereto a mechanically controllable valve drive, wherein each gas exchange valve has assigned thereto a respective working contour which directly or indirectly acts on the gas exchange valve.

The present invention will be explained in greater detail hereunder with reference to the drawings FIG. 1 shows an embodiment of a valve drive arrangement 10 according to the present invention comprising a plurality of serially arranged gas exchange valves 12, 14, 16, 18, 20 and 22. There are shown, in this context, a drag lever 66 and a cross-sectional view of a valve shaft of the respective gas exchange valves 12, 14, 16, 18, 20 and 22 which are arranged in a known manner in cylinders 13, 15 and 17. In the case illustrated here, two respective inlet gas exchange valves are assigned to one cylinder of the internal combustion engine. In the present case, the mechanically controllable valve drive arrangement 10 comprises three transmission arrangements 28, 30 and 32, each of them having assigned thereto two gas exchange valves 12, 14; 16, 18; 20, 22. In this configuration, the transmission arrangements 28, 30, and 32 are supported by bearing means 36 on an adjustment shaft 35. In FIG. 1, said bearing means 36 are merely shown as an example of the support of adjustment shaft 35.

As still to be described in greater detail below, each transmission arrangement comprises a first and a second wheel element 40, 42, the first wheel element 40 being operatively connected to a camshaft 46 via a contact roll 44. Both wheel elements 40, 42 are rotatably supported on adjustment shaft 35 and are in a geared connection with each other so that a rotation of adjustment shaft 35 will effect a phase shift between the first and second wheel elements 40, 42 and that a rotary fixing will effect an oscillating movement of the first and second wheel elements 40, 42 in the same sense.

In the shown embodiment, the adjustment shaft 35 is driven in a known manner by a drive member 48. As a drive member 48, use is made of a rotary drive adapted for forward as well as for rearward rotation. Adjustment shaft 35 can thus be driven in that the valve stroke corresponding to the next operational state will be selected in a fast and precise manner in dependence on the current position. Rotary angles >360° can thereby be realized.

Figure 3:
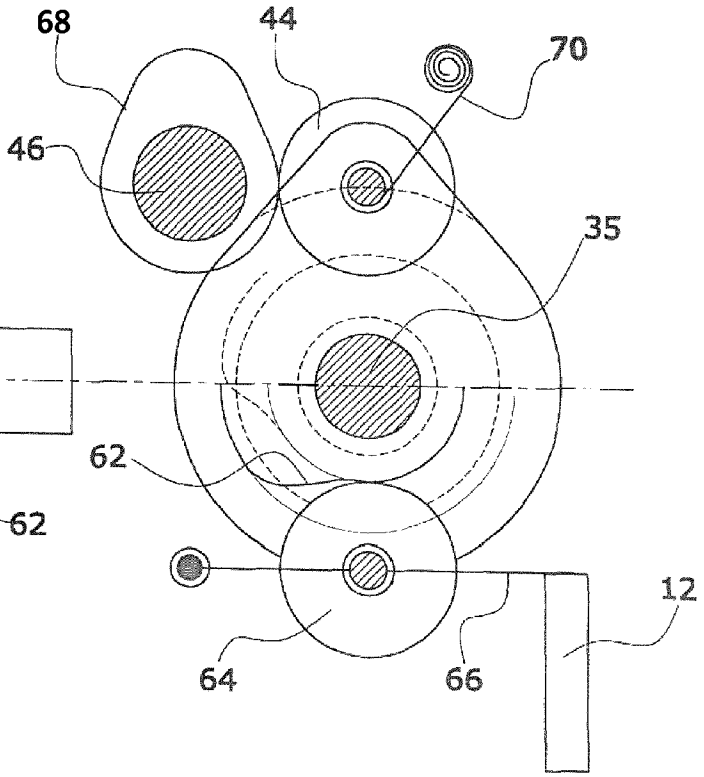
FIG. 3 shows a cross-sectional view of a first embodiment of a valve drive according to the present invention.
Figure 2:
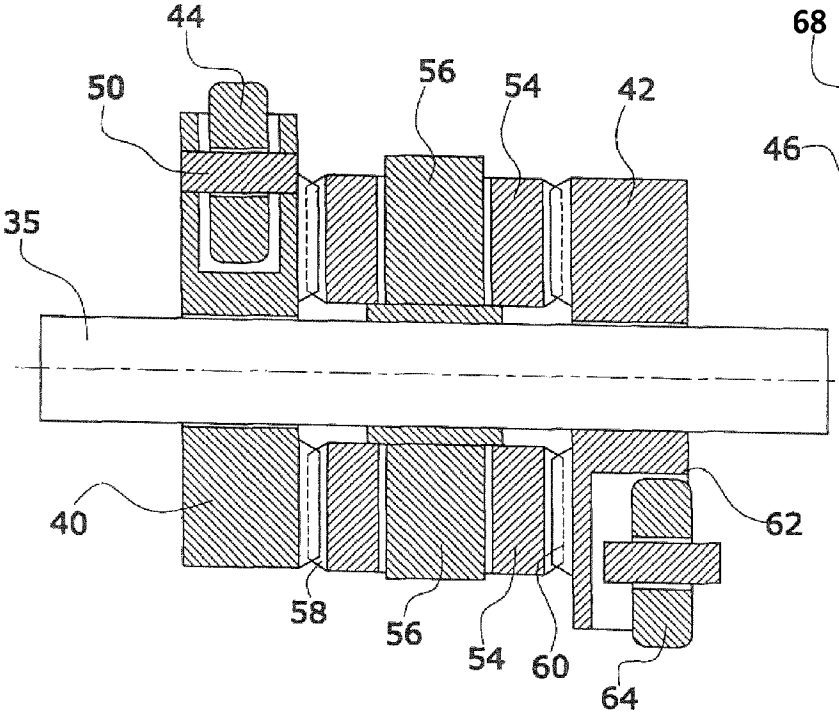
FIG. 2 shows a longitudinal view of a first embodiment of a valve drive according to the present invention.

FIG. 2 shows, in longitudinal sectional view, a first embodiment of a mechanically controllable valve drive. Illustrated is a valve drive which acts on a gas exchange valve 12. The adjustment shaft 35 is rotatably supported in the cylinder head and can be rotated by the drive member 48 shown in FIG. 1. Rotatably supported on adjustment shaft 35 is, to begin with, the first wheel element 40. Via a fixed axis 50, the first wheel element 40 takes up the freely rotatable contact roll 44 for the camshaft 46. The first wheel element 40 is further formed as a crown gear, with its toothing 52 oriented toward the second wheel element 42. The first wheel element 40 meshes with a plurality, for example, three, planetary gears 54 of which, in the present embodiment, two are shown and which are each supported on a fixed axis 56 connected to the adjustment shaft for common rotation therewith. These planetary gears 54 in turn mesh, via their toothing 58, with the toothing 60 of the second wheel element 42 which is likewise formed as crown gear. As can be seen in FIG. 3, the second wheel element 42 comprises the working contour 62 which is operatively connected to a roll 64 of drag lever 66.

The functionality of the first embodiment is as follows: In the state of rotary fixation of adjustment shaft 35, the continuously rotating camshaft 46 will cause the first wheel member 40 to oscillate about the adjustment shaft 35 via a drive cam 68. The planetary gears 54 will thereby also be subjected to an oscillating movement, which finally will result in an oscillating movement of the second wheel element 42 in the opposite sense to the first wheel element 40. In this way, the gas exchange valve 12 will then be opened and closed again via the working contour 62 in a known manner.

Now, if it is desired to change the maximum stroke of the gas exchange valve 12, adjustment shaft 35 will be rotated by the drive member 48. By this rotation, the fixed axes 56 of the planetary gears 54 will be moved in the rotational direction of adjustment shaft 35 whereby the phase relationship between the first and the second wheel elements 40, 42 will be changed and, correspondingly, the roll 64 of drag lever 66 will come into contact with a different section of the working contour 62 during the opening and closing movement.

FIG. 3 is a cross-sectional view of the first embodiment of the present invention wherein the gas exchange valve 12 is shown in the closed state. By means of a spring element 70, the first wheel element 40 is biased relative to camshaft 46. The gear ratios between the first wheel element 40 and the planetary gears 54 and between the planetary gears 54 and the second wheel element 42 do not have to be identical. In certain applications, a gear ratio differing from 1:1 can be advantageous.

Figure 4:
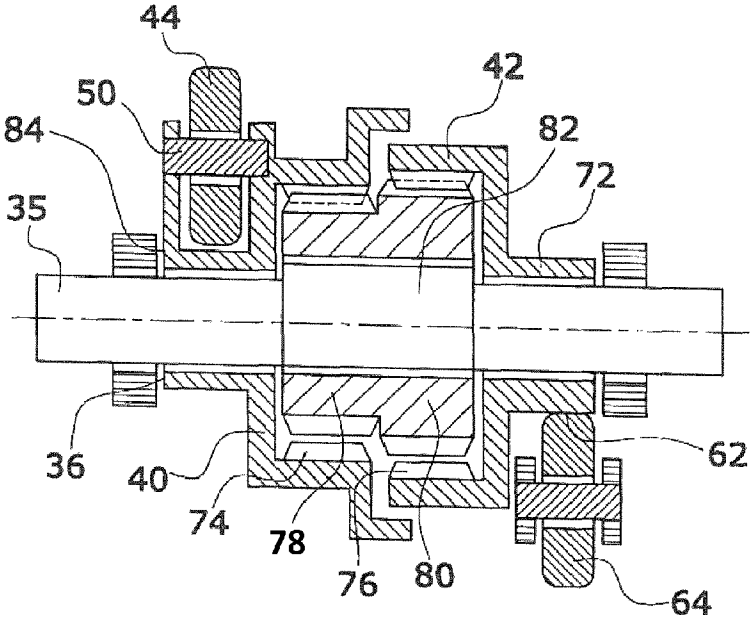
FIG. 4 shows a longitudinal view of a second embodiment of a valve drive according to the present invention.

FIG. 4 is a longitudinal sectional view of a second embodiment of the present invention. The first and the second wheel element 40, 42 are here also rotatably supported on the adjustment shaft 35, wherein, as in the first embodiment, the first wheel element 40 takes up the freely rotatable contact roll 44 for the camshaft 46 via the fixed axis 50. As shown in FIG. 3, the second wheel element 42 can comprise the working contour 62. The design of the second wheel element 42 is here such that the working contour 62 is positioned on a projection 72 of wheel element 42.

In this second embodiment, the geared connection between the first and second wheel element 40, 42 which in the present case are formed as internal gears 74, 76, is realized by a first and a second spur gear 78, 80 arranged rotatably on an eccentric 82. The eccentric 82 is formed on adjustment shaft 35 in a known manner. The first and the second spur gear 78, 80 are formed as one piece. For effecting a phase shift between the first and the second wheel element 40, 42, it is provided that the first and second wheel elements 40, 42 and the associated spur gears 78, 80 comprise different numbers of teeth. In the present embodiment, the first wheel element 40 and the associated first spur gear 78 have a smaller diameter and thus a smaller number of teeth than the second wheel element 42 and the associated second spur gear 80. In this manner, there is realized a high reduction ratio between the rotation of the adjustment shaft 35 and the intended phase shift between the two wheel elements 40, 42. Via a disk spring 84 supported on the bearing 36 of adjustment shaft 35, and by a sliding profile displacement (performed in the same sense) of the gear connection between, on the one hand, the first wheel element 40 and the first spur gear 78, and, on the other hand, between the second wheel element 42 and the second spur gear 80, the whole geared connection can be biased, and tooth-flank play can be avoided.

Figure 5:
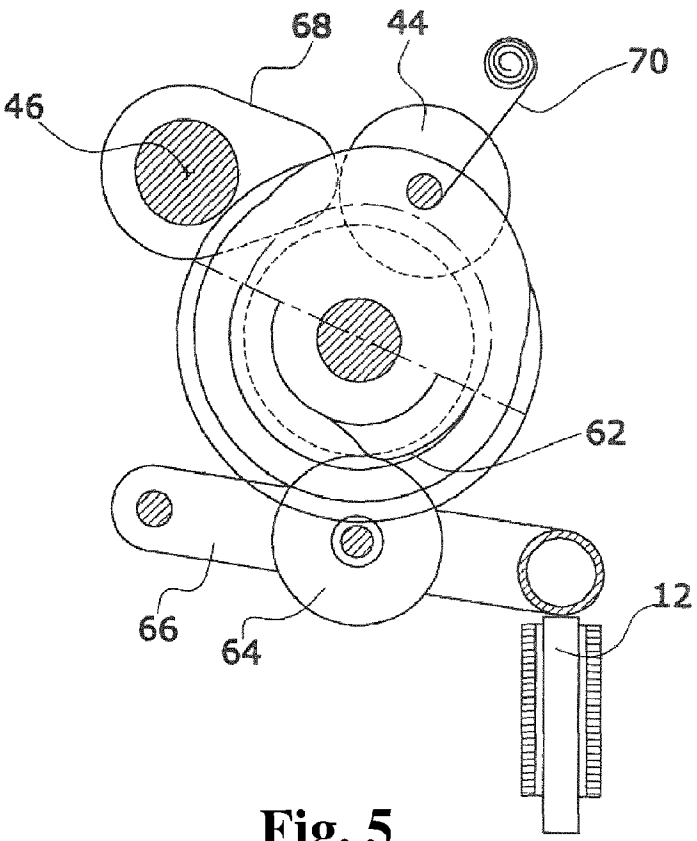
FIG. 5 shows a cross-sectional view of a second embodiment of a valve drive according to the present invention.

FIG. 5 shows, for the present embodiment, the gas exchange valve 12 in the opened state with preset maximum valve stroke.

The functionality of the second exemplary embodiment is as follows: For representation of a preset maximum stroke of gas exchange valve 12, the adjustment shaft 35 is rotationally fixed. The continuously rotating camshaft 46, via its drive cam 68, causes the first wheel element 40 to oscillate about adjustment shaft 35. Via the geared connection of the first wheel element 40 to the second wheel element 42, also the second wheel element 42 is subjected to an oscillating movement in the same sense. Via the working contour 62 of projection 72 of second wheel element 42, this oscillating movement will then be transmitted onto the roll 64 of drag lever 66, so that the gas exchange valve 12 will be opened and closed again in a known manner with the preset maximum stroke.

If it is now intended to change the maximum stroke of the gas exchange valve 12, there is also in this case performed a rotation of the adjustment shaft 35 by means of the drive member 48. Through this rotation, the position of the eccentric 82 will also be changed, and the first and the second spur gear 78, 80 will be rotated in the same sense. However, due to the different sizes and the different numbers of teeth of the gear pairs "first wheel element-first spur gear" 40, 78 and "second wheel element-second spur gear" 42, 80, a phase shift will take place between the first wheel element 40 and the second wheel element 42. In correspondence thereto, the projection 72 of second wheel element 42 will also be rotated by a desired angle so that, during the opening and closing movement, the roll 64 of drag lever 66 will come into contact with a different portion of the working contour 62 of the projection of second wheel element 42.

Figure 6:
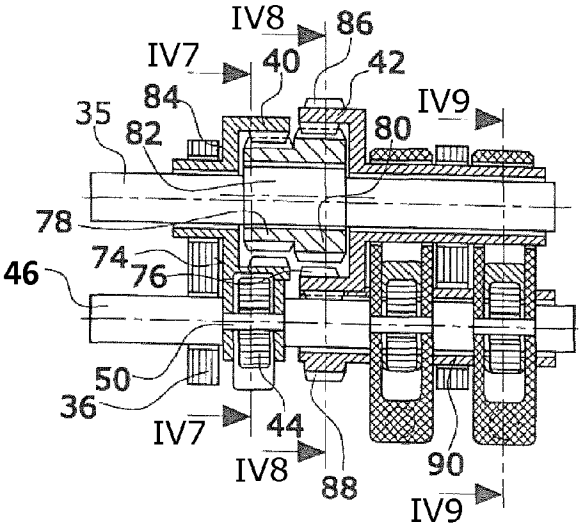
FIG. 6 shows a longitudinal view of a third embodiment of a valve drive according to the present invention.

FIG. 6 is a longitudinal sectional view of a third embodiment of the present invention. This embodiment represents a particularly compact solution because the entire transmission arrangement is supported only about two axes, adjustment shaft 35, and camshaft 46. It is advantageous that, in comparison to a valve drive with fixed maximum stroke, the position of the camshaft need not be changed. This unit can also be mounted in a simple and inexpensive manner as a pre-examined unit, since all component parts are supported in the two axes 35, 46.

As also the case in the exemplary embodiments according to FIGS. 4 and 5, there are provided a first and a second wheel element 40, 42 arranged rotatably on the adjustment shaft 35. The first and second wheel elements 40, 42 are formed as internal gears 74, 76 having different sizes and different numbers of teeth, while being in geared connection with each other via two spur gears 78, 80. As in the second exemplary embodiment, the two spur gears 78, 80 are rotatably supported on an eccentric 82 of adjustment shaft 35 and, corresponding to the meshing internal gears 74, 76, have different sizes and different numbers of teeth.

Figure 7:
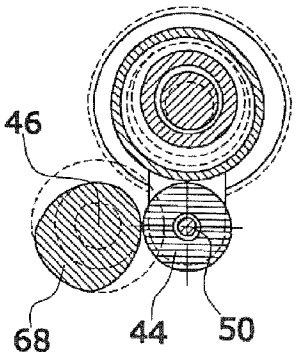
FIG. 7 shows a first cross-sectional view of a third embodiment of a valve drive according to the present invention.

The first wheel element 40 also comprises a fixed axis 50 (see FIG. 7) on which the contact roll 44 for the drive cam 68 is rotatably supported, the latter herein having a different shape than in the preceding exemplary embodiments.

Figure 9:
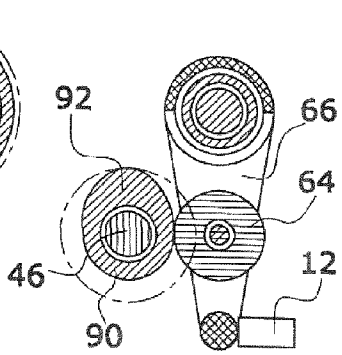
FIG. 9 shows a third cross-sectional view of a third embodiment of a valve drive according to the present invention.
Figure 8:
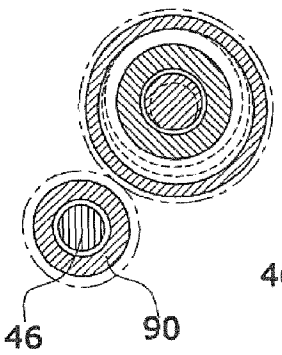
FIG. 8 shows a second cross-sectional view of a third embodiment of a valve drive according to the present invention.

The second wheel element 42 further comprises an outer toothing 86 in operative connection with the outer toothing 88 of a deflection member 90 which in turn is rotatably supported on camshaft 46 (see also FIG. 8). In the present case, said deflection member 90 comprises two deflection cams 92 describing a working contour and engaging the roll 64 of a drag lever 66 of a gas exchange valve 12 in a known manner. The drag levers 66 in turn are rotatably supported on adjustment shaft 35 (see FIG. 9).

By means of a disk spring 84 supported in the axial direction on the bearing 36 of camshaft 46 and on the deflection member 90, and by means of sliding profile displacements, performed in the same sense, of the tooth connection between the outer toothing 88 of deflection member 90 and the outer toothing 86 of second wheel element 42, between the second wheel element 42 and the second spur gear 80, as well as between the first wheel element 40 and the second spur gear 78, it is rendered possible to bias the entire geared connection and to eliminate the tooth-flank play.

The functionality of the third exemplary embodiment is as follows: In case of a preset maximum stroke of the gas exchange valve 12 which is to be actuated, adjustment shaft 35 is rotationally fixed. Via its drive cam 68, the continuously rotating camshaft 46 causes the first wheel element 40 to oscillate about adjustment shaft 35. Via the geared connection of the first wheel element 40 to the second wheel element 42, also the second wheel element 42 is subjected to an oscillating movement in the same sense. Via the outer gear toothing 86 of second wheel element 42, this oscillating movement is then translated into an oscillating movement of deflection member 90 in the opposite sense. By means of the deflection cam 92 engaging drag lever 66, gas exchange valve 12 will be opened and closed again in a known manner with the preset maximum stroke.

Now, if it is intended to change the maximum stroke of the gas exchange valve 12, there is also in this case performed a rotation of the adjustment shaft 35 by the drive member 48. By this rotation, also the position of the eccentric 82 will be changed, and the first and the second spur gear 78, 80 will be rotated in the same sense. However, due to the different sizes and the different numbers of teeth of the gear pairs "first wheel element-first spur gear" 40, 78 and "second wheel element-second spur gear" 42, 80, a phase shift will take place between the first wheel element 40 and the second wheel element 42. In correspondence thereto, the deflection member 90 will also be rotated by a desired angle so that, during the opening and closing movement, the roll 64 of drag lever 66 will come into contact with a different portion of the deflection cam 92.

In the above embodiment according to FIGS. 6 to 9, special advantages are achieved because, due to the transmission ratio between the outer toothing 86 of wheel element 42 and the outer toothing 88 of deflection member 90, the oscillating movement of deflection member 90 will pass over a larger angular range than preset by the first wheel element 40. This will result in more-favorable force ratios on the working contour of deflection cam 92.

All of the described embodiments can be designed in such a manner that the deflection member will perform an oscillating movement with a merely small pivoting lever. For variation of the maximum valve strokes in the range between zero stroke and full stroke, there is used only a part of the whole periphery of the deflection member. It is thus possible to place a further and different working contour on the remaining part of the periphery. These contours can be used, for example, for a controlled deactivation of individual gas exchange valves of a cylinder so as to guarantee a more precise quantity control and to trigger a needs-oriented load movement in the cylinder, or also to deactivate all valves of a cylinder in order to represent a switch-off of the cylinder.

The present invention is not limited to embodiments described herein; reference should be had to the appended claims.

What is claimed is:

1. A mechanically controllable valve drive comprising:

a gas exchange valve on which a transmission arrangement is configured to directly or indirectly act via a working contour, the transmission arrangement comprising a first wheel element comprising a toothing which is operatively connected to a camshaft, a second wheel element comprising a toothing which is configured to act directly or indirectly on the gas exchange valve, the transmission arrangement being mounted so as to be movable in a cylinder head via a bearing, and to be operatively connected the camshaft and to a valve stroke adjusting device comprising an adjusting shaft which is configurable to be rotatable and to set different maximum strokes;

at least one planetary gear; and an axis connected to the adjusting shaft which is configured to commonly rotate therewith, wherein, the first wheel element and the second wheel element are each mounted on the adjusting shaft so as to rotate and to be in a geared connection with each another via their respective toothing so that a rotation of the adjusting shaft effects a phase shift between the first wheel element and the second wheel element, and so that a rotary fixing generates an oscillating movement of the first wheel element and the second wheel element, the first wheel element and the second wheel element are provided as mutually confronting crown gears, the geared connection is realized via the at least one planetary gear, and each of the at least one planetary gear is supported on the axis connected to the adjusting shaft.

2. The mechanically controllable valve drive as recited in claim 1, further comprising a spring element, wherein the first wheel element is configured to be prestressed relative to the camshaft via the spring element.

3. The mechanically controllable valve drive as recited in claim 1, wherein, the first wheel element and the second wheel element are provided as internal gears, the first wheel element further comprising an inner diameter with a number of teeth, the second wheel element further comprising an inner diameter with a number of teeth, the inner diameter and the number of teeth of the first wheel element being different than the inner diameter and the number of teeth of the second wheel element, and the adjustment shaft comprises an eccentric comprising a first spur gear and a second spur gear rotatably supported on the eccentric, the first spur gear and the second spur gear being coupled to each other in a torsionally rigid manner and being configured engage with the first wheel element and the second wheel element, respectively, so as to form the geared connection.

4. The mechanically controllable valve drive as recited in claim 3, wherein the first spur gear and the second spur gear are provided as one part.

5. The mechanically controllable valve drive as recited in claim 3, wherein the first wheel element further comprises a peripheral surface and the second wheel element is configured to be rotatably supported on the peripheral surface of the first wheel element.

6. The mechanically controllable valve drive as recited in claim 3, further comprising a deflecting member which comprises the working contour, the deflecting member being configured so as to rotate to be and concentrically supported on the camshaft, wherein the second wheel element is configured to be in a geared connection with the deflecting member.

7. The mechanically controllable valve drive as recited in claim 6, further comprising a drag lever configured to be rotatably supported on the adjusting shaft.

8. The mechanically controllable valve drive as recited in claim 1, wherein the first wheel element further comprises a contact roll for the camshaft.

9. The mechanically controllable valve drive as recited in claim 1, wherein the second wheel element comprises the working contour.

10. A mechanically controllable valve drive arrangement comprising:

a plurality of cylinders;

a plurality of gas exchange valves arranged in series, the plurality of gas exchange valves being assigned to the plurality of cylinders; and a mechanically controllable valve drive as recited in claim 1 assigned to each of the plurality of cylinders, wherein, each of the plurality of gas exchange valve has a respective working contour assigned thereto which is configured to directly or indirectly act on the respective gas exchange valve.

11. A mechanically controllable valve drive comprising a gas exchange valve on which a transmission arrangement is configured to directly or indirectly act via a working contour, the transmission arrangement comprising a first wheel element comprising a toothing which is operatively connected to a camshaft and an inner diameter with a number of teeth, a second wheel element comprising a toothing which is configured to act directly or indirectly on the gas exchange valve and an inner diameter with a number of teeth, the transmission arrangement being mounted so as to be movable in a cylinder head via a bearing, and to be operatively connected the camshaft and to a valve stroke adjusting device comprising an adjusting shaft which is configurable to be rotatable and to set different maximum strokes, wherein, the first wheel element and the second wheel element are each mounted on the adjusting shaft so as to rotate and to be in a geared connection with each another via their respective toothing so that a rotation of the adjusting shaft effects a phase shift between the first wheel element and the second wheel element, and so that a rotary fixing generates an oscillating movement of the first wheel element and the second wheel element, the first wheel element and the second wheel element are provided as internal gears, the inner diameter and the number of teeth of the first wheel element being different than the inner diameter and the number of teeth of the second wheel element, and the adjustment shaft comprises an eccentric comprising a first spur gear and a second spur gear rotatably supported on the eccentric, the first spur gear and the second spur gear being coupled to each other in a torsionally rigid manner and being configured engage with the first wheel element and the second wheel element, respectively, so as to form the geared connection.

12. The mechanically controllable valve drive as recited in claim 11, further comprising a spring element, wherein the first wheel element is configured to be prestressed relative to the camshaft via the spring element.

13. The mechanically controllable valve drive as recited in claim 11, further comprising at least one planetary gear, and an axis connected to the adjusting shaft which is configured to commonly rotate therewith, wherein the first wheel element and the second wheel element are provided as mutually confronting crown gears, the geared connection is realized via the at least one planetary gear, and each of the at least one planetary gear is supported on the axis connected to the adjusting shaft.

14. The mechanically controllable valve drive as recited in claim 11, wherein the first spur gear and the second spur gear are provided as one part.

15. The mechanically controllable valve drive as recited in claim 11, wherein the first wheel element further comprises a peripheral surface and the second wheel element is configured to be rotatably supported on the peripheral surface of the first wheel element.

16. The mechanically controllable valve drive as recited in claim 11, wherein the first wheel element further comprises a contact roll for the camshaft.

17. The mechanically controllable valve drive as recited in claim 11, wherein the second wheel element comprises the working contour.

18. The mechanically controllable valve drive as recited in claim 11, further comprising a deflecting member which comprises the working contour, the deflecting member being configured so as to rotate to be and concentrically supported on the camshaft, wherein the second wheel element is configured to be in a geared connection with the deflecting member.

19. The mechanically controllable valve drive as recited in claim 18, further comprising a drag lever configured to be rotatably supported on the adjusting shaft.

20. A mechanically controllable valve drive arrangement comprising:

a plurality of cylinders;

a plurality of gas exchange valves arranged in series, the plurality of gas exchange valves being assigned to the plurality of cylinders; and a mechanically controllable valve drive as recited in claim 11 assigned to each of the plurality of cylinders, wherein, each of the plurality of gas exchange valve has a respective working contour assigned thereto which is configured to directly or indirectly act on the respective gas exchange valve.

* * * * *